US005771714A

United States Patent [19]

Emley et al.

[11] Patent Number: 5,771,714

[45] Date of Patent: Jun. 30, 1998

[54] CRYOGENIC RECTIFICATION SYSTEM FOR PRODUCING HIGHER PURITY HELIUM

[75] Inventors: Rae Lynn Emley, Buffalo; James Joseph Maloney, Amherst, both of N.Y.

[73] Assignee: Praxair Technology, Inc., Danbury, Conn.

[21] Appl. No.: 904,591

[22] Filed: Aug. 1, 1997

[51] Int. Cl.[6] ..... F25J 1/00

[52] U.S. Cl. ..... 62/639; 62/923

[58] Field of Search ..... 62/639, 923

[56] References Cited

U.S. PATENT DOCUMENTS

| | | | |
|---|---|---|---|
| 3,807,185 | 4/1974 | Forg et al. | 62/639 |
| 4,238,211 | 12/1980 | Stuart | 62/639 |
| 4,666,481 | 5/1987 | Olson, Jr. | 62/11 |
| 4,701,200 | 10/1987 | Fisher et al. | 62/27 |
| 4,701,201 | 10/1987 | Hanson et al. | 62/27 |
| 5,329,775 | 7/1994 | Fiedler et al. | 62/24 |
| 5,339,641 | 8/1994 | Mathis et al. | 62/639 |

OTHER PUBLICATIONS

Rathmann et al., *Linde Reports on Science and Technology No. 34, 1982.*

Pahade et al., *Thermal Integrated of Processes to Recover Helium,* Energy Process, vol. 8, No. 4, Dec., 1988 pp. 196–200.

Handley et al., *Process Requirements and Enhanced Economics of Helium Recovery from Natural Gas,* Soc. of Petroleum Engineers SPE 24292, Apr. 13, 1992 pp. 11–20.

*Primary Examiner*—Ronald C. Capossela

*Attorney, Agent, or Firm*—Stanley Ktorides

[57] ABSTRACT

The production of higher purity helium wherein a feed comprising helium, nitrogen and hydrocarbons is processed in a system comprising two columns operating at different pressure levels, with the product helium produced in the higher pressure column and nitrogen and hydrocarbons cycled to the lower pressure column.

7 Claims, 1 Drawing Sheet

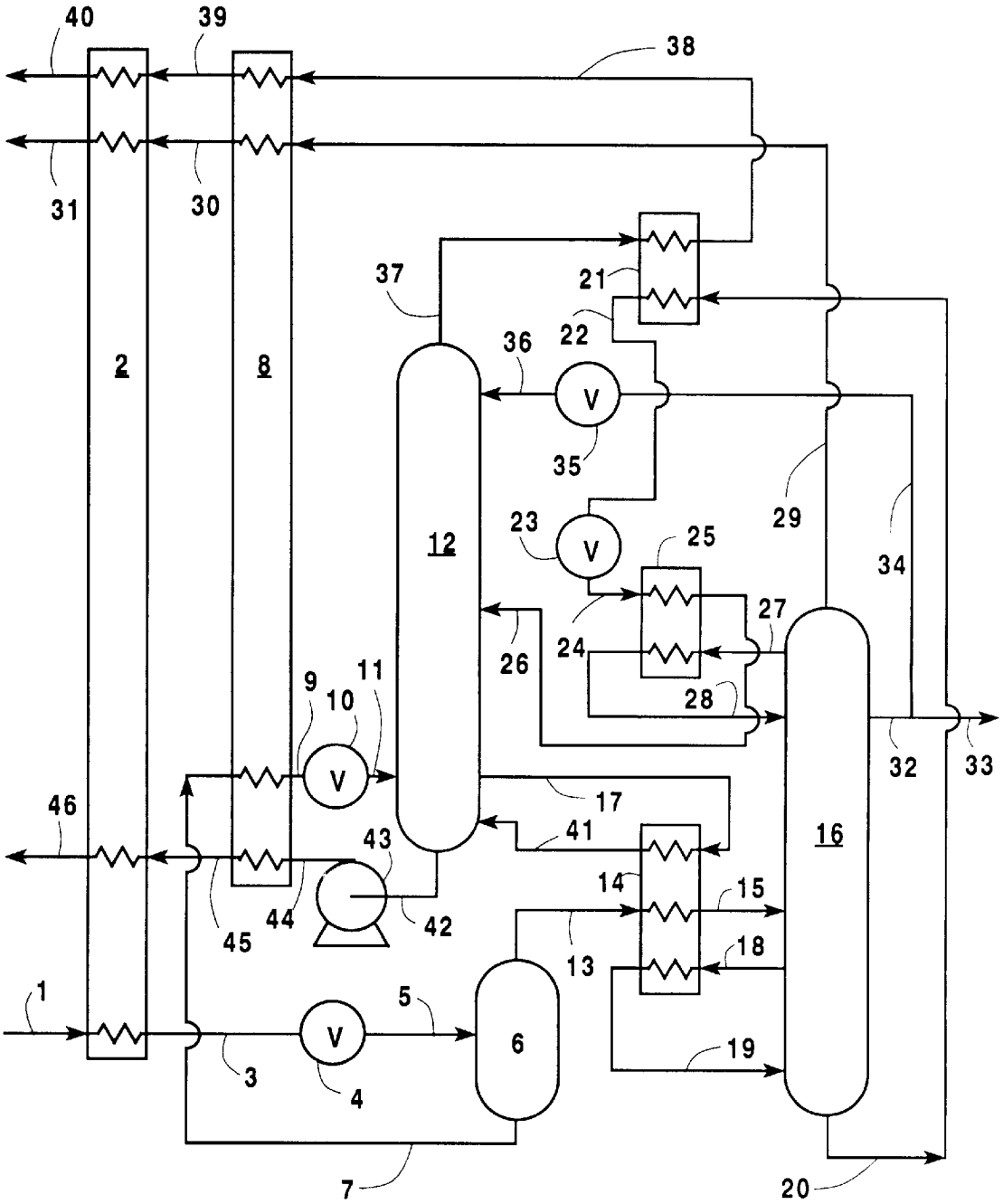
40
39
38
31
30
37
21
22
36
2
8
V
35
29
23
12
25
34
24
27
26
28
9
10
11
V
32
33
17
46
41
16
43
14
15
44
42
45
13
18
1
5
V
6
19
3
4
7
20

CRYOGENIC RECTIFICATION SYSTEM FOR PRODUCING HIGHER PURITY HELIUM

TECHNICAL FIELD

This invention relates generally to the production of helium and, more particularly, to the production of helium by cryogenic rectification.

BACKGROUND OF THE INVENTION

Heretofore, crude helium has been produced from natural gas to a purity level of about 50 percent and then passed on to a helium refinery for the production of refined helium. This relatively standard purity for crude helium is the result government requirements, and helium production facilities have historically been designed to produce helium at this purity level for passage on to a helium refinery.

The higher the purity and the higher the pressure of the helium passed on to the helium refinery, the less is the energy required to operate the helium refinery. However, typical helium production systems cannot effectively produce helium with a purity much higher than about 50 percent.

Accordingly, it is an object of this invention to provide a system for producing helium by separation from hydrocarbon fluid at a higher purity than that possible with conventional systems.

SUMMARY OF THE INVENTION

The above and other objects, which will become apparent to one skilled in the art upon a reading of this disclosure, are attained by the present invention, one aspect of which is:

A method for producing higher purity helium by cryogenic rectification comprising:

(A) processing a feed comprising helium, nitrogen and hydrocarbons to produce a first fluid enriched in hydrocarbons, and a second fluid enriched in helium;

(B) passing the first fluid into a lower pressure column and passing the second fluid into a higher pressure column;

(C) separating the second fluid within the higher pressure column by cryogenic rectification to produce a helium-richer fluid, a nitrogen-richer fluid and a hydrocarbons-richer fluid;

(D) passing nitrogen-richer fluid and hydrocarbons-richer fluid from the higher pressure column into the lower pressure column; and (E) recovering helium-richer fluid from the higher pressure column as product higher purity helium.

Another aspect of the invention is:

Apparatus for producing higher purity helium by cryogenic rectification comprising:

(A) means for dividing a feed comprising helium, nitrogen and hydrocarbons into a first fluid enriched in hydrocarbons, and into a second fluid enriched in helium;

(B) a first column and means for passing the first fluid into the first column;

(C) a second column and means for passing the second fluid into the second column;

(D) means for passing fluid from the upper portion of the second column into the first column and means for passing fluid from the lower portion of the second column into the first column; and (E) means for recovering fluid from the upper portion of the second column as product higher purity helium.

As used herein, the term "hydrocarbons" means one or more hydrocarbon species.

As used herein, the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process.*

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 160 degrees Kelvin (K).

As used herein, the term "indirect heat exchange" means the bringing of two fluid streams into heat exchange relation without any physical contact or intermixing of the fluids with each other.

As used herein, the terms "upper portion" and "lower portion" means those sections of a column respectively above and below the midpoint of the column.

As used herein, the term "tray" means a contacting stage, which is not necessarily an equilibrium stage, and may mean other contacting apparatus such as packing having a separation capability equivalent to one tray.

As used herein, the term "equilibrium stage" means a vapor-liquid contacting stage whereby the vapor and liquid leaving the stage are in mass transfer equilibrium, e.g. a tray having 100 percent efficiency or a packing element height equivalent to one theoretical plate (HETP).

BRIEF DESCRIPTION OF THE DRAWING

The sole FIGURE is a schematic representation of one preferred embodiment of the higher purity helium production system of this invention.

DETAILED DESCRIPTION

The invention enables the production of higher purity helium, typically having a purity of 70 mole percent or more, from a hydrocarbon feedstock for passage on to a helium refinery for the production of refined helium. In a particularly preferred embodiment, the invention additionally produces liquid nitrogen which may also be used in the helium refinery.

The invention will be described in greater detail with reference to the Drawing. Referring now to the Figure, feed stream 1, which is at a pressure generally within the range of from 100 to 2000 pounds per square inch absolute (psia), is cooled by passage through heat exchanger 2 by indirect heat exchange with return streams to form cooled feed stream 3. Feed stream 1 is a vapor comprising helium, nitrogen and hydrocarbons. Helium is present in feed stream 1 in a concentration within the range of from 0.1 to 10 mole percent; nitrogen is present in feed stream 1 in a concentration within the range of from 5 to 79.9 mole percent; hydrocarbons are present in feed stream 1 in a concentration within the range of from 20 to 94.9 mole percent. The hydrocarbons may comprise solely methane or may comprise methane along with ethane and one or more other heavier constituents commonly found in natural gas. Feed stream 1 may also contain one or more lower boiling or more volatile components such as hydrogen, neon, oxygen and argon.

Cooled feed steam 3 is passed from heat exchanger 2 to valve 4 through which it is throttled to form two phase stream 5. Phase separator 6 receives stream 5 and within phase separator 6 the fluid in stream 5 is separated into a liquid or first fluid which is enriched in hydrocarbons, i.e. having a hydrocarbons concentration which exceeds that of feed stream 1, and into a vapor or second fluid which is enriched in helium, i.e. having a helium concentration which exceeds that of feed stream 1. The first fluid, which also contains nitrogen and may contain trace amounts of helium, is passed from phase separator 6 as stream 7 through heat exchanger 8 wherein it is subcooled by indirect heat exchange with return streams. Resulting subcooled stream 9 is flashed across valve 10 and then passed as stream 11 into first or lower pressure column which is operating at a pressure generally within the range of from 15 to 200 psia.

The second fluid, which also contains nitrogen and hydrocarbons, is passed from phase separator 6 as stream 13 through heat exchanger 14 wherein it is partially condensed. Resulting partially condensed stream 15 is then passed as feed into second or higher pressure column 16 which is operating at a pressure higher than that of lower pressure column 12 and generally within the range of from 100 to 500 psia.

Within higher pressure column 16 the feed is separated by cryogenic rectification into a helium-richer fluid, a nitrogen-richer fluid and a hydrocarbons-richer fluid. A liquid stream 18 is withdrawn from column 16 and partially vaporized by passage through heat exchanger 14 by indirect heat exchange with the aforesaid partially condensing second fluid. Resulting two-phase stream 19 is returned to column 16. The vapor portion of stream 19 provides vapor upflow for column 16. The liquid portion of stream 19 comprises hydrocarbons-richer fluid. Hydrocarbons-richer fluid is withdrawn from the lower portion of column 16 as stream 20 and subcooled by passage through heat exchanger 21. Resulting subcooled stream 22 is throttled across valve 23 and then passed as stream 24 through heat exchanger 25 wherein it is at least partially vaporized. Resulting fluid is passed in stream 26 from heat exchange 25 into lower pressure column 12.

The fluid comprising stream 24 is at least partially vaporized in heat exchanger 25 by indirect heat exchange with a vapor passed in stream 27 from column 16 through heat exchanger 25 wherein it is partially condensed. Resulting two-phase stream 28 is returned to column 16. The liquid portion of stream 28 provides liquid downflow for column 16. The vapor portion of stream 28 comprises helium-richer fluid. Helium-richer fluid is withdrawn from the upper portion of column 16 as stream 29 and warmed by passage through heat exchanger 8. Resulting warmed helium-richer stream 30 is further warmed by passage through heat exchanger 2 and recovered as product higher purity helium 31 having a helium concentration of at least 65 mole percent and generally having a helium concentration within the range of from 70 to 95 mole percent. Preferably higher purity helium 31 is recovered at an elevated pressure, generally within the range of from 100 to 400 psia. Higher purity helium 31 may be passed on to a helium refinery as a feed stream for the production of refined helium.

Nitrogen-richer fluid is withdrawn as liquid in stream 32 from the upper portion of higher pressure column 16 at a level generally not more than ten equilibrium stages below the level from which helium-richer fluid in stream 29 is withdrawn from column 16. Preferably the nitrogen-richer fluid is withdrawn from column 16 at the same equilibrium stage as that from which helium-richer stream 29 is withdrawn. The nitrogen-richer fluid will generally have a nitrogen concentration of at least 95 mole percent. Preferably, as illustrated in the Figure, a portion 33 of stream 32 is recovered as product liquid nitrogen. This product liquid nitrogen may conveniently be employed as refrigerant in a helium liquefier. The remaining portion 34 of stream 32 may be throttled across valve 35 and passed as stream 36 into lower pressure column 12 as reflux.

Within column 12 the feeds are separated by cryogenic rectification into nitrogen vapor and hydrocarbon liquid. The nitrogen vapor is withdrawn from column 12 as stream 37 and warmed by passage through heat exchanger 21 by indirect heat exchange with the subcooling hydrocarbons-richer fluid in stream 20. Resulting warmed nitrogen vapor 38 is warmed by passage through heat exchanger 8, resulting stream 39 is further warmed by passage through heat exchanger 2, and resulting nitrogen vapor stream 40 is passed out of the system. Stream 40 may be released to the atmosphere or may be recovered, in whole or in part, such as for use such as in secondary hydrocarbon recovery.

A liquid stream is removed from column 12 as stream 17 and passed through heat exchanger 14 wherein it is partially vaporized by indirect heat exchange with the aforesaid partially condensing second fluid 13. Resulting two phase stream 41 is returned to column 12. The vapor portion of stream 41 provides vapor upflow for column 12. The liquid portion of stream 41 comprises hydrocarbon liquid. The hydrocarbon liquid is withdrawn from the lower portion of column 12 as stream 42. Preferably the hydrocarbon liquid is increased in pressure, such as by passage through liquid pump 43 as illustrated in the Figure. Resulting pressurized hydrocarbon liquid 44 is warmed by passage through heat exchanger 8 and resulting stream 45 is warmed and preferably vaporized by passage through heat exchanger 2. Resulting hydrocarbon stream 46 is recovered as product methane or natural gas having a hydrocarbons concentration generally within the range of from 90 to 100 mole percent.

Table 1 presents the results of a computer simulation of one example of the invention, using an embodiment similar to that illustrated in the Figure. The stream numbers in Table 1 correspond to those of the Figure. This example is presented for illustrative purposes and is not intended to be limiting.

TABLE 1

| Stream No. | Flowrate (lbmol/hr) | Temperature K | Pressure (psia) | composition (mole %) He | N2 | C1 plus |
|---|---|---|---|---|---|---|
| 1 | 1000 | 160 | 400 | 2.0 | 58.0 | 40.0 |
| 46 | 414 | 150 | 100 | 0.0 | 4.0 | 96.0 |
| 31 | 26 | 150 | 400 | 75.0 | 25.0 | 0.0 |
| 40 | 560 | 150 | 30 | 0.1 | 99.4 | 0.5 |

As can be seen from the example reported in Table 1, the invention enables the production of helium separated from a hydrocarbon fluid, having a concentration significantly higher than that attainable effectively with conventional processes. In the specific example reported in Table 1, the product higher purity helium has a helium concentration of 75 mole percent from a feed stream having a helium concentration of only 2 mole percent.

Although the invention has been described in detail with reference to a certain preferred embodiment, those skilled in the art will recognize that there are other embodiments of the invention within the spirit and the scope of the claims.

We claim:

1. A method for producing higher purity helium by cryogenic rectification comprising:

(A) processing a feed comprising helium, nitrogen and hydrocarbons to produce a first fluid enriched in hydrocarbons, and a second fluid enriched in helium;

(B) passing the first fluid into a lower pressure column and passing the second fluid into a higher pressure column;

(C) separating the second fluid within the higher pressure column by cryogenic rectification to produce a helium-richer fluid, a nitrogen-richer fluid and a hydrocarbons-richer fluid;

(D) passing nitrogen-richer fluid and hydrocarbons-richer fluid from the higher pressure column into the lower pressure column; and (E) recovering helium-richer fluid from the higher pressure column as product higher purity helium.

2. The method of claim 1 wherein the product higher purity helium has a helium concentration of at least 65 mole percent.

3. The method of claim 1 further comprising recovering a portion of the nitrogen-richer fluid from the higher pressure column.

4. The method of claim 1 further comprising producing nitrogen vapor within the lower pressure column and recovering nitrogen vapor from the upper portion of the lower pressure column.

5. The method of claim 1 further comprising producing hydrocarbon liquid within the lower pressure column, withdrawing hydrocarbon liquid from the lower portion of the lower pressure column, and recovering resulting fluid as product having a hydrocarbons concentration within the range of from 90 to 100 mole percent.

6. Apparatus for producing higher purity helium by cryogenic rectification comprising:

(A) means for dividing a feed comprising helium, nitrogen and hydrocarbons into a first fluid enriched in hydrocarbons, and into a second fluid enriched in helium;

(B) a first column and means for passing the first fluid into the first column;

(C) a second column and means for passing the second fluid into the second column;

(D) means for passing fluid from the upper portion of the second column into the first column and means for passing fluid from the lower portion of the second column into the first column; and (E) means for recovering fluid from the upper portion of the second column as product higher purity helium.

7. The apparatus of claim 6 further comprising means for recovering fluid from the lower portion of the first column.

* * * * *